US011788269B1

(12) United States Patent
Acker

(10) Patent No.: US 11,788,269 B1
(45) Date of Patent: Oct. 17, 2023

(54) SUB FLOOR DAMAGE PREVENTION TOILET PAN

(71) Applicant: John Acker, Indianapolis, IN (US)

(72) Inventor: John Acker, Indianapolis, IN (US)

( * ) Notice: Subject to any disclaimer, the term of this patent is extended or adjusted under 35 U.S.C. 154(b) by 0 days.

(21) Appl. No.: 17/495,016

(22) Filed: Oct. 6, 2021

(51) Int. Cl.
*E03D 11/16* (2006.01)

(52) U.S. Cl.
CPC ..... *E03D 11/16* (2013.01)

(58) Field of Classification Search
CPC ..... E03D 11/16; F16B 35/00; F16B 35/04; F16B 35/041; F16B 35/042; G01M 3/04; G01M 3/042
See application file for complete search history.

(56) References Cited

U.S. PATENT DOCUMENTS

| | | | | |
|---|---|---|---|---|
| 2,229,814 | A | 1/1941 | Mikolajczak et al. | |
| 2,758,316 | A | 8/1958 | Schwartz et al. | |
| 4,165,545 | A | 8/1979 | Stoltzfus | |
| 6,430,756 | B1 * | 8/2002 | Reilly | E03D 11/16 411/395 |
| 7,069,603 | B2 | 7/2006 | Flushing | |
| 7,934,516 | B1 | 5/2011 | Jaynes | |
| 8,776,280 | B2 | 7/2014 | Baranj et al. | |
| 10,907,337 | B1 | 2/2021 | Schmidt | |
| 10,996,130 | B2 * | 5/2021 | Ghodrati | E03D 11/16 |
| 2021/0164213 | A1 * | 6/2021 | Earnest | E03D 11/16 |

* cited by examiner

*Primary Examiner* — Janie M Loeppke
(74) *Attorney, Agent, or Firm* — CRAMER PATENT & DESIGN, PLLC; Aaron R. Cramer

(57) ABSTRACT

A sub floor damage prevention toilet pan is a pan that secures around the wax ring of a toilet bowl. The base of a pan contains a drain which may be plumbed into pre-existing wastewater line.

11 Claims, 5 Drawing Sheets

SUB FLOOR DAMAGE PREVENTION TOILET PAN

RELATED APPLICATIONS

Non-applicable.

FIELD OF THE INVENTION

The present invention relates generally to a toilet pan and more specifically to a toilet pan to prevent sub floor damage.

BACKGROUND OF THE INVENTION

There is perhaps no greater household disaster than water damage. Not only do the physical portions of the house such as walls, woodwork, drywall, carpeting and the like get ruined, but personal belongings such as furniture, appliances and the like get destroyed as well. While water damage due to hurricanes or flooded rivers is out of our control in most cases, a great deal of damage can occur from faulty devices such as toilets, sinks and appliances.

While the market has responded with drain or catch pans for sinks, water heaters, washing machines and the like, nothing to date has been provided for toilets. Leaking wax rings and misaligned toilet rings can not only destroy ceilings directly below toilets but can result in wet and rotted subfloors in bathroom areas leading to costly repairs. Accordingly, there exists a need for a means by which minor leaks from toilet can be controlled until proper repairs can be made. The development of the Sub Floor Damage Prevention Toilet Pan fulfills this need.

SUMMARY OF THE INVENTION

To achieve the above and other objectives, the present invention provides for a toilet leak protection device which has, a main pan area with a plurality of sides and a plurality of openings, a low rim disposed on the sides of the main pan area, a wax ring assembly having a wax torus include a bottom support and an interior flange, with the interior flange adapted to be disposed inside of the waste piping connection, and a pair of toilet flange bolt assemblies fastening the toilet leak protection device on top of the wax ring assembly and below the wax ring assembly. The openings include a waste opening, a pair of flange bolt openings, and a bypass drain opening.

The bypass drain opening may be adapted to be connected to a bypass drain piping. The bypass drain piping may be routed to a remote location. The remote location may be a crawlspace. The remote location may be an exterior location. The bypass drain piping may be not connected to a sanitary line. The bypass drain piping may be not connected to a storm line. The toilet leak protection device may capture any errant water and direct it away via the bypass drain piping when the toilet and/or the wax ring assembly develop a leak, becomes loose or as the wax ring degrades. The bypass drain opening may be adapted to be disposed in front of the toilet bottom where it will not interfere with the waste piping connection. The main pan area may cover an area from behind a bottom of the toilet bottom, around the wax ring assembly and an area bordered by the pair of flange opening bolts. The low rim may retain any released water and may be adapted to prevent water from damaging a flooring and a ceiling prior to its release via the bypass drain opening and the bypass drain piping.

The pair of toilet flange bolt assemblies may each have a flat head. The pair of toilet flange bolt assemblies may have a hollow bolt with an interior. The interior of the bolt shaft may include a plurality of access holes at the level of the main pain area. The interior of the bolt shaft may be filled with a moisture wicking material to lift any water moisture to on top of the bolt shaft. The bolt shaft may pass through the toilet bottom and may be terminated via a captive washer and a nut. The toilet leak protection device may comprise a decorative cap having a color changing insert. The color changing insert may change color when exposed to moisture through the moisture wicking material. The toilet leak protection device may be disposed on top of the wax ring assembly and below the wax ring assembly. The toilet leak protection device may be made of polyvinyl chloride plastic.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
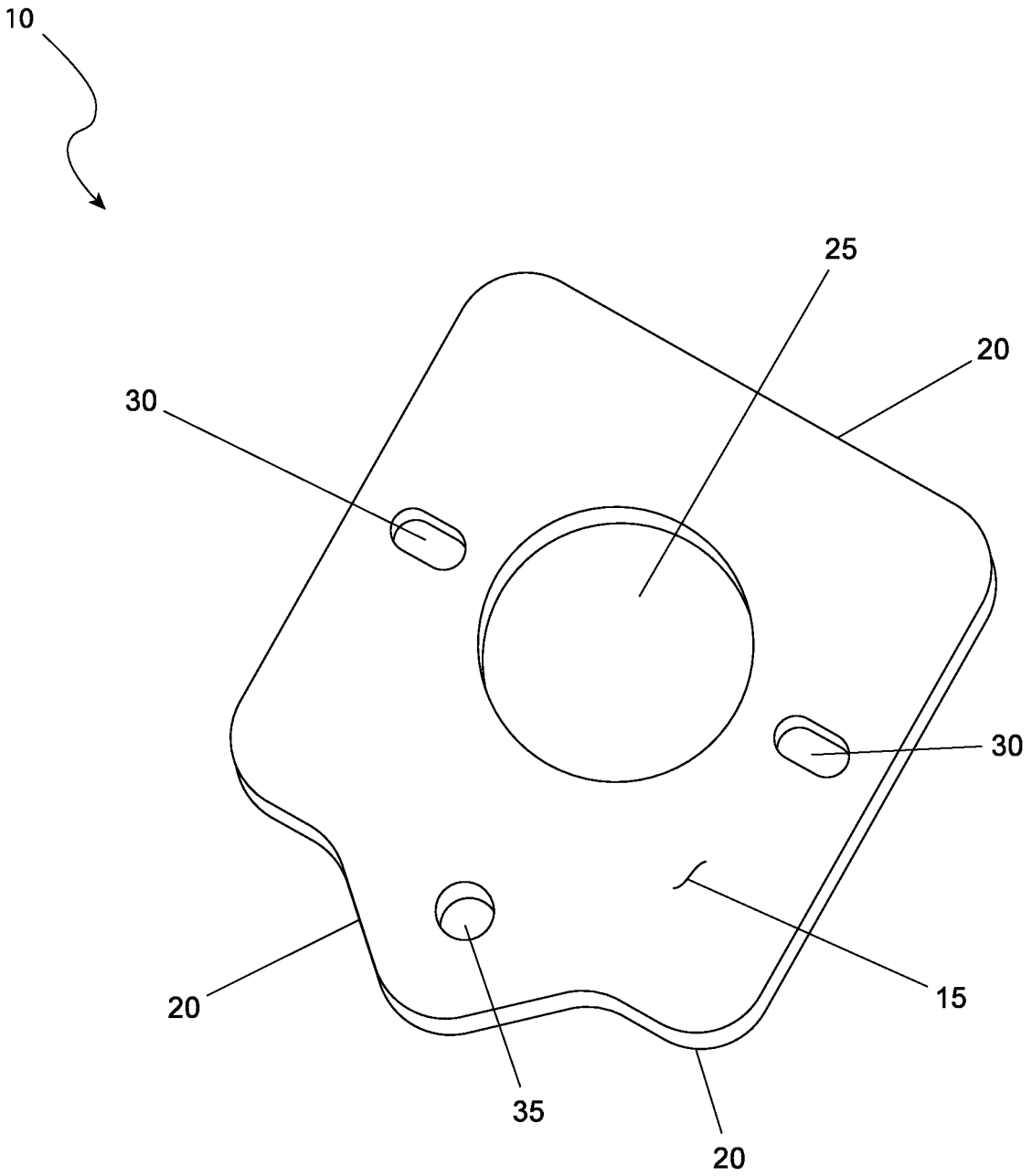
FIG. 1 is a perspective view of the toilet leak protection device, according to the preferred embodiment of the present invention.

10 toilet leak protection device
15 main pan area
20 low rim
25 waste opening
30 flange opening bolt
35 bypass drain opening
40 toilet
45 waste piping connection
50 floor flange
55 wax ring assembly
60 bypass drain piping
65 remote location
70 flooring
75 ceiling
80 toilet bottom
85 wax torus
90 bottom support
95 interior flange
100 toilet flange bolt assembly
105 flat head
110 toilet flange bolt area
115 bolt shaft
120 access hole

125 moisture wicking material
130 captive washer
135 nut
140 decorative cap
145 color changing insert

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the FIGS

Referring now to FIG. 1, a perspective view of the toilet leak protection device 10, according to the preferred embodiment of the present invention is disclosed. The toilet leak protection device (herein also described as the "device") 10, functions to catch leaking water from a wax ring assembly 55. The toilet leak protection device 10 comprises a main pan area that is bordered on all sides with a low rim 20. The main pan area 15 may have a generally square shape to prevent exposed overhang. Openings in the main pan area 15 include a waste opening 25, two (2) flange bolt openings 30, and a bypass drain opening 35. Functionality and operation of the waste opening 25, the flange opening bolts 30, and the bypass drain opening will be described in greater detail herein below. The device 10 would be made of durable polyvinyl chloride (PVC) plastic.

Figure 2:
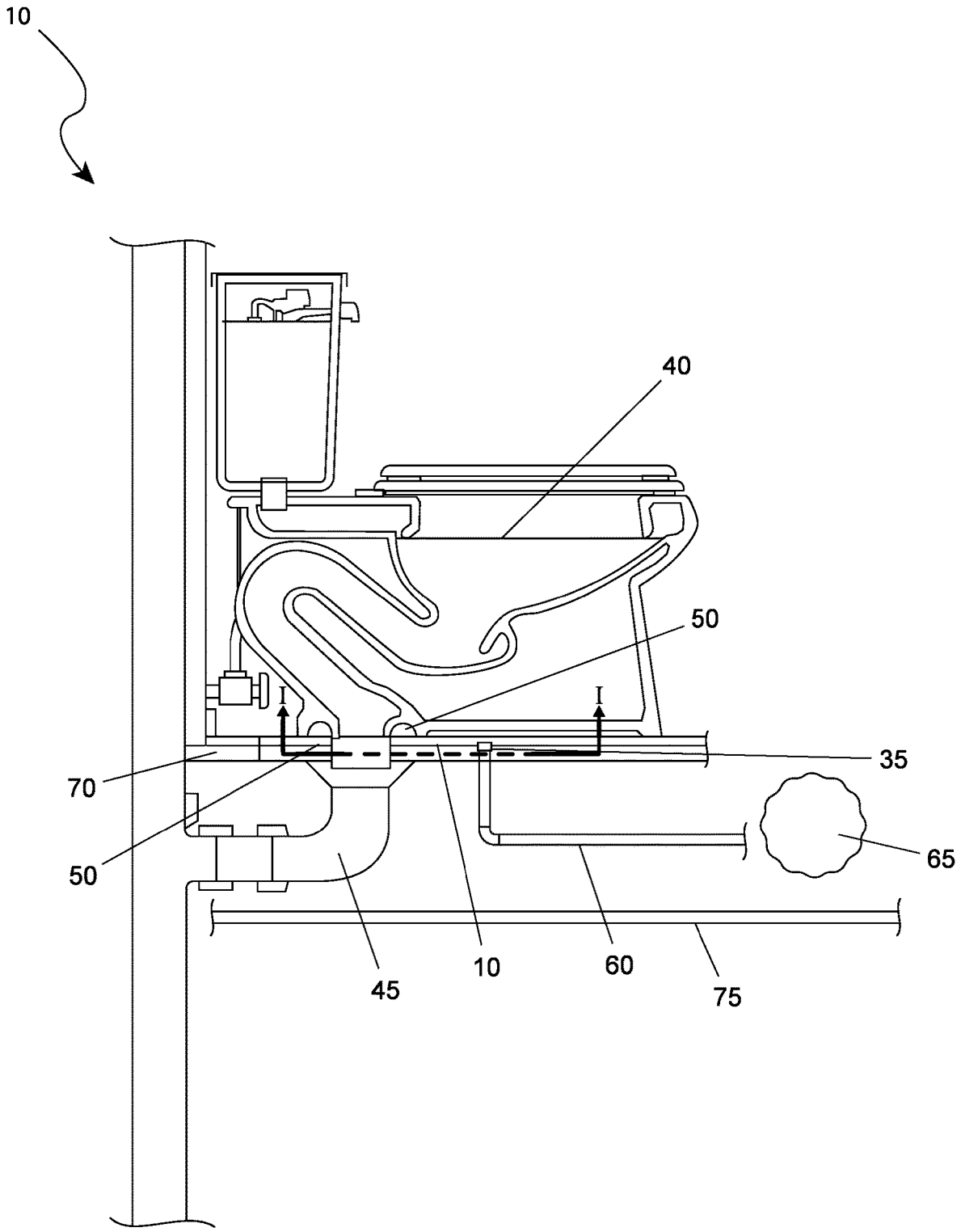
FIG. 2 is a sectional view of the toilet leak protection device, shown in an installed state, according to the preferred embodiment of the present invention.

Referring next to FIG. 2, a sectional view of the device 10, shown in an installed state, according to the preferred embodiment of the present invention is depicted. A toilet 40 is installed in a normal manner complete with a waste piping connection 45. The device 10 is located atop a wax ring assembly 55 and below the wax ring assembly 55. Further detail on this connection will be provided herein below. The bypass drain opening 35 is connected to a bypass drain piping 60. The bypass drain piping 60 is routed to a remote location 65 such as a crawlspace, exterior location, or the like. The bypass drain piping 60 is not connected to any sanitary line or storm line. Should the toilet 40 and/or the wax ring assembly 55 develop a leak later in its life either as it ages, becomes loose or as the wax ring degrades, any errant water is then captured by the device 10 and directed safely away via the bypass drain piping 60. This protects the flooring 70 and any ceiling 75 (should it be provided) from damage and allows for the wax ring assembly 55 to be repaired in a non-emergency manner.

Figure 3:
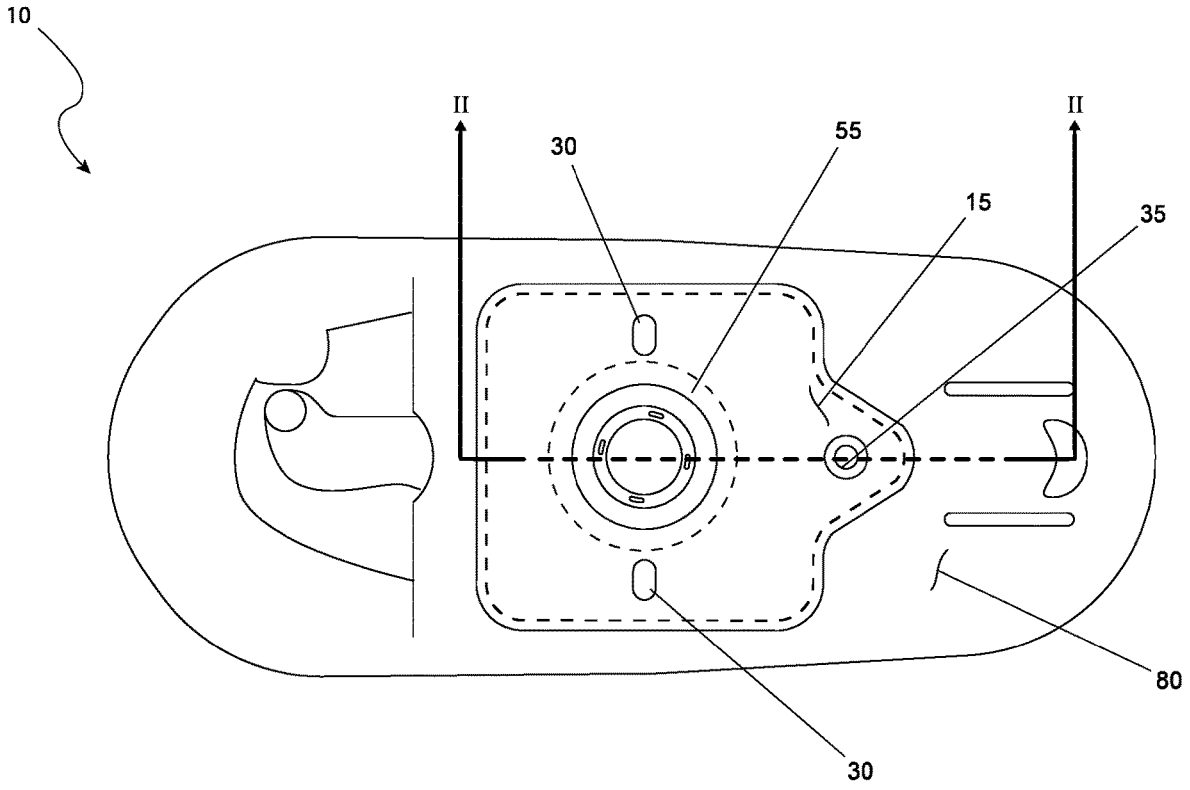
FIG. 3 is a sectional view of the toilet leak protection device, as seen along a Line I-I, as shown in FIG. 2, according to the preferred embodiment of the present invention.

Referring now to FIG. 3, a sectional view of the device 10, as seen along a Line I-I, as shown in FIG. 2, according to the preferred embodiment of the present invention is shown. The toilet leak protection device 10 is positioned on the toilet bottom 80 as shown. The main pan area 15 covers the area from the rear of the toilet bottom 80, around the wax ring assembly 55 (herein shown by dashed lines due to its hidden nature), and includes the area bordered by the flange opening bolts 30. The bypass drain opening 35 is located at the front of the toilet bottom 80 where it will not interfere with the waste piping connection 45 (as shown in FIG. 2). The placement of the device 10 on the underside of the wax ring assembly 55 ensures that any deformation of the wax ring assembly 55 over time, will result in any released water being captured by the device 10.

Figure 4:
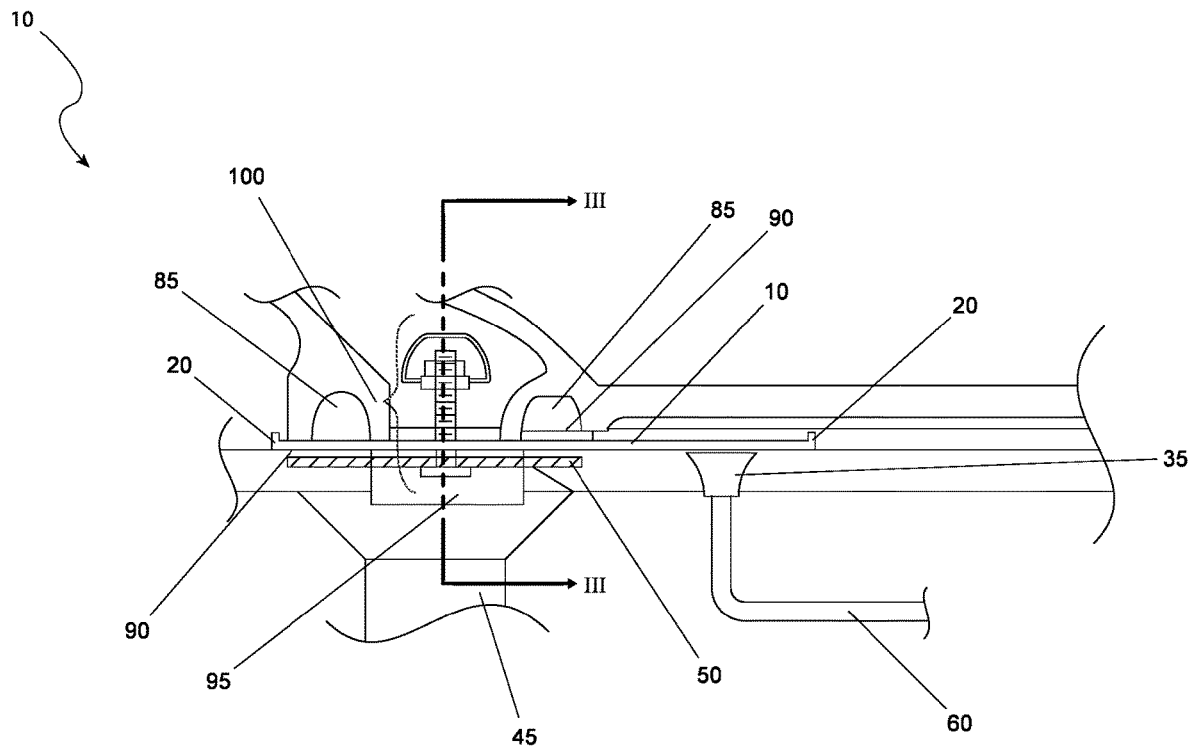
FIG. 4 is a detailed sectional view of the toilet leak protection device, as seen along a Line II-II, as shown in FIG. 3, according to the preferred embodiment of the present invention; and, FIG. 5 is detailed sectional view of the toilet flange bolt assemblies as used with the toilet leak protection device, as seen along a Line III-III, as shown in FIG. 4, according to the preferred embodiment of the present invention.

Referring next to FIG. 4, a detailed sectional view of the device 10, as seen along a Line II-II, as shown in FIG. 3, according to the preferred embodiment of the present invention is disclosed. The wax ring assembly 55 comprises a wax torus 85 and may also include a bottom support 90 and an interior flange 95, with the interior flange 95 inside of the waste piping connection 45. The exact type of wax ring assembly 55 used with the device 10 is not intended to be a limiting factor of the present invention. As aforementioned described, the device 10 is located between the wax torus 85 (or bottom support 90) and the floor flange 50. It is held captive by two (2) toilet flange bolt assemblies 100 (of which only one (1) is shown due to illustrative limitations). As the leaking water is not under pressure, the low rim 20 retains any released water and prevents water from damaging the flooring 70 and any ceiling 75 (as shown in FIG. 2), prior to its release via the bypass drain opening 35 and the bypass drain piping 60.

Figure 5:
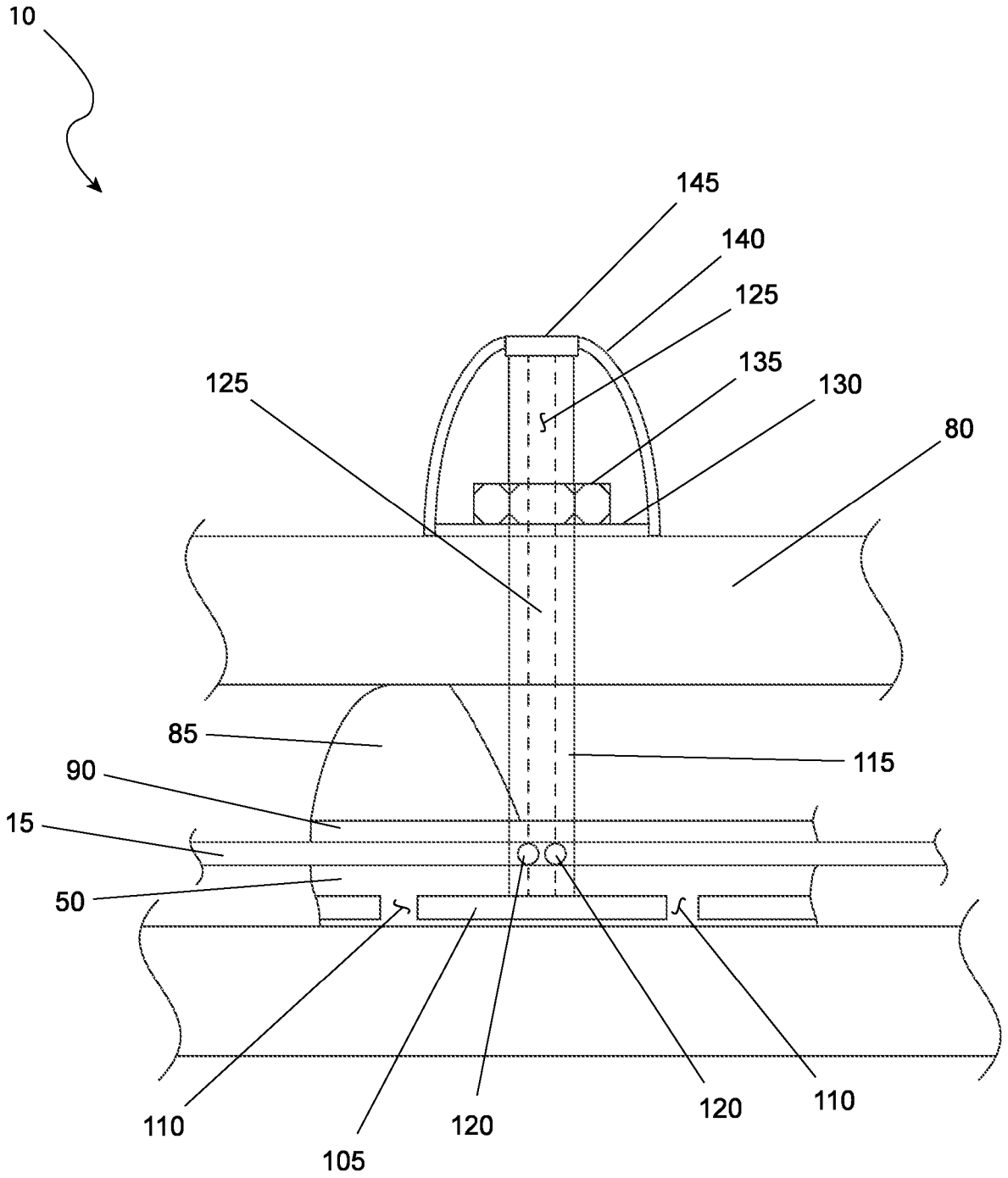

Referring to FIG. 5, a detailed sectional view of the toilet flange bolt assemblies 100 as used with the device 10, as seen along a Line III-III, as shown in FIG. 4, according to the preferred embodiment of the present invention is depicted. The toilet flange bolt assemblies 100 is provided with a flat head 105 that connects to the toilet flange bolt assemblies 100 of the floor flange 50. The toilet flange bolt assemblies 100 also provides for a bolt shaft 115 which is hollow in nature. Access to the interior of the bolt shaft 115 is provided by multiple access holes 120 at the level of the main pain area 15. Should any water errantly pass by the wax torus 85 and/or the bottom support 90 (if provided), it will enter through the access holes 120. The interior of the bolt shaft 115 is filled with a moisture wicking material 125 which will lift any water moisture to the top of the bolt shaft 115. The bolt shaft 115 passes through the toilet bottom 80 and is terminated via captive washer 130 and a nut 135 in a conventional manner. A decorative cap 140 is provided with a color changing insert 145. The color changing insert 145 is envisioned to change color under the presence of moisture as provided through the moisture wicking material 125. For example, under normal dry conditions, the color changing insert 145 would be white in color, to match the color of most toilet 40 (as shown in FIG. 2) and the decorative cap 140. Under the presence of moisture, it would change color to red. Such color change would be noted by the user during normal usage or cleaning operations. This alerting function provided by the color changing insert 145 provides adequate time to properly repair the toilet 40 and or the wax torus 85 to prevent associated subsequent damage. The indication function provided by the color changing insert 145 is needed due to the closed operation of the device 10 whose operation cannot be observed from the exterior of the toilet 40. Upon repair, the device 10 and the toilet flange bolt assemblies 100

(as shown in FIG. 4) would be replaced to allow for continued operating and alerting functionality.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 5. The user would procure the device 10 from conventional procurement channels such as hardware stores, home improvement stores, mechanical supply houses, mail order and internet supply houses and the like.

After procurement and prior to utilization, the toilet leak protection device 10 would be prepared in the following manner: installation would occur either as part of new construction or as part of a renovation in which the toilet 40 is removed; the two (2) toilet flange bolt assemblies 100 would be installed in the toilet flange bolt area 110 of the floor flange 50 in a conventional manner; the device 10 would be placed atop the floor flange 50 such that the toilet flange bolt assemblies 100 are inside of the flange opening bolts 30; the bypass drain opening 35 would be connected to the bypass drain piping 60; the bypass drain piping 60 would be routed to a remote location 65; the wax ring assembly 55 would be installed on the toilet bottom 80 in a conventional manner; the toilet 40 would be placed atop the device 10; installation would then proceed with the placement and tightening of the captive washer 130, the nut 135 and the decorative cap 140. At this point in time, the device 10 is ready for use. The pair of flange bolt openings 30 may be a pair of horizontal elongated flange bolt openings to facilitate installation of the main pan area.

During utilization of the device 10, the following procedure would be initiated: operation would proceed in a transparent manner to the user of the device 10. Should water leakage occur around the wax ring assembly 55, said leaked water will accumulate in the main pain area 15 and travel down the bypass drain opening 35, through the bypass drain piping 60 and to the remote location 65. Simultaneously, water will enter the access holes 120 of the bolt shaft 115 on the toilet flange bolt assemblies 100 and travel up the moisture wicking material 125. At the top, said moisture will contact the color changing insert 145 and result in a visible color change on the top exterior of the decorative cap 140. Upon visualizing the color change, the user may take appropriate action to correct, repair or replace the wax ring assembly 55 or other problem resulting in leakage.

After use of the device 10, it is reinstalled with new toilet flange bolt assemblies 100, a new decorative cap 140 and new color changing insert 145 to continue functioning in a repeating and cyclical manner.

The features of the present invention are ideal for new construction or retrofit applications. While the teachings of the device 10 may be applied on any toilet 40, it is viewed as especially beneficial on upper floors of a home or business where finished ceiling are directly below the device 10 equipped toilet 40. The device 10 prevents major water damage from leaking toilet 40 to flooring 70, ceiling 75, structures, and virtually anything located below the toilet 40.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A toilet leak protection device, comprising:

a main pan area with a plurality of sides and a plurality of openings, the openings include a waste opening, a pair of flange bolt openings, and a bypass drain opening, the main pan area has a square shape to prevent overhang and the pair of flange bolt openings are a pair of horizontal elongated apertures to facilitate installation;

a low rim disposed on the sides of the main pan area;

a wax ring assembly having a wax torus, a bottom support, and an interior flange, with the interior flange adapted to be disposed inside of the waste piping connection; and a pair of toilet flange bolt assemblies fastening the toilet leak protection device on top of the wax ring assembly and below the wax ring assembly;

wherein the bypass drain opening is connected to a bypass drain piping;

wherein the toilet leak protection device captures any errant water and directs the water away via the bypass drain piping when the toilet and/or the wax ring assembly develop a leak, becomes loose or as the wax ring degrades;

wherein the bypass drain opening is adapted to be disposed in front of a toilet bottom where it will not interfere with the waste piping connection;

wherein the pair of toilet flange bolt assemblies have a bolt shaft with an interior;

wherein the interior of the bolt shaft includes a plurality of access holes at a level of the main pan area;

wherein the interior of the bolt shaft is filled with a moisture wicking material to lift water moisture to on top of the bolt shaft and the color changing insert changes color when exposed to moisture through the moisture wicking material; and, wherein the bolt shaft passes through the toilet bottom and is terminated via a captive washer and a nut.

2. The toilet leak protection device, according to claim 1, wherein the bypass drain piping is routed to a remote location.

3. The toilet leak protection device, according to claim 1, wherein the remote location is a crawlspace.

4. The toilet leak protection device, according to claim 1, wherein the remote location is an exterior location.

5. The toilet leak protection device, according to claim 1, wherein the bypass drain piping is not connected to a sanitary line.

6. The toilet leak protection device, according to claim 1, wherein the bypass drain piping is not connected to a storm line.

7. The toilet leak protection device, according to claim 1, wherein the main pan area covers an area from behind a bottom of the toilet bottom, around the wax ring assembly and an area bordered by the pair of flange opening bolts.

8. The toilet leak protection device, according to claim 1, wherein the low rim retains any released water and is adapted to prevent water from damaging a flooring and a ceiling prior to its release via the bypass drain opening and the bypass drain piping.

9. The toilet leak protection device, according to claim 1, wherein the pair of toilet flange bolt assemblies each have a flat head.

10. The toilet leak protection device, according to claim 1, further comprising a decorative cap having a color changing insert.

11. The toilet leak protection device, according to claim 1, wherein the toilet leak protection device is made of polyvinyl chloride plastic.

* * * * *